US005373529A

United States Patent [19]

Zanner et al.

[11] Patent Number: 5,373,529

[45] Date of Patent: Dec. 13, 1994

[54] METALS PURIFICATION BY IMPROVED VACUUM ARC REMELTING

[75] Inventors: Frank J. Zanner, Sandia Park; Rodney L. Williamson; Mark F. Smith, both of Albuquerque, all of N. Mex.

[73] Assignee: Sandia Corporation, Albuquerque, N. Mex.

[21] Appl. No.: 843,871

[22] Filed: Feb. 27, 1992

[51] Int. Cl.[5] ..... F27D 17/00

[52] U.S. Cl. ..... 373/56; 373/62; 373/68

[58] Field of Search ..... 373/56, 65, 67–69, 373/72, 75, 76, 77, 102, 124, 110, 112, 62

[56] References Cited

U.S. PATENT DOCUMENTS

| | | | |
|---|---|---|---|
| 2,564,337 | 8/1951 | Maddex | 373/56 |
| 2,782,245 | 2/1957 | Preston | 373/67 |
| 3,264,095 | 8/1966 | Ackermann | 373/65 |
| 3,353,585 | 11/1967 | Wentzell | 373/67 |
| 4,007,770 | 2/1977 | Timmons | 373/67 |
| 4,450,570 | 5/1984 | Weingartner et al. | 373/69 |
| 4,953,177 | 8/1990 | Tommaney et al. | 373/68 |
| 5,103,458 | 4/1992 | Soykan | 373/67 |
| 5,142,549 | 8/1992 | Bremer | 373/10 |

*Primary Examiner*—Bruce A. Reynolds
*Assistant Examiner*—Tu Hoang
*Attorney, Agent, or Firm*—George H. Libman; Timothy D. Stanley

[57] ABSTRACT

The invention relates to improved apparatuses and methods for remelting metal alloys in furnaces, particularly consumable electrode vacuum arc furnaces. Excited reactive gas is injected into a stationary furnace arc zone, thus accelerating the reduction reactions which purify the metal being melted. Additionally, a cooled condensation surface is disposed within the furnace to reduce the partial pressure of water in the furnace, which also fosters the reduction reactions which result in a purer produced ingot. Methods and means are provided for maintaining the stationary arc zone, thereby reducing the opportunity for contaminants evaporated from the arc zone to be reintroduced into the produced ingot.

18 Claims, 2 Drawing Sheets

METALS PURIFICATION BY IMPROVED VACUUM ARC REMELTING

GOVERNMENT RIGHTS

The U.S. Government has a paid-up license in this invention and the right in limited circumstances to require the patent owner to license others on reasonable terms as provided for by the terms of the contract.

BACKGROUND OF THE INVENTION

1. Field of the Invention (Technical Field)

This invention relates to improved apparatuses and methods for remelting metal alloys.

2. Background Art

Vacuum arc remelting ("VAR") is a melting and solidification process used to produce high quality ingots of chemically reactive or segregation sensitive alloys. The alloy is cast or forged into an electrode, and then remelted and solidified in a vacuum. A sustained high (several kiloamperes) direct current is used to induce an electrical arc between the electrode and a conductive container. Energy from the electrical arc melts the electrode (which, as mentioned, is cast from the alloy to be remelted) into the container.

It is known in the art that VAR improves the quality of alloys subjected to its processes. Among other things, the following improvements in the produced ingot have been noted:

(1) Contained gases, especially hydrogen and oxygen, are reduced;

(2) The alloy is cleaner (fewer non-metallic inclusions);

(3) Center porosity and segregation in the ingot are greatly reduced; and (4) Mechanical properties of the remelted alloy, such as ductility and fatigue strength, are improved.

Presently, VAR is the most commonly used melting process used to produce ingots for many wrought alloy applications. VAR is particularly well-suited to melting nickel-based "superalloys" (such as Alloy 718) which contain substantial quantities of reactive elements, because melting is performed in a vacuum and the solidification environment can be controlled to the optimum. It is also known that equilibrium phase relationships dictate the solutal partition at the solidification interfaces, and that local conditions about the arc zone thus determine the chemical homogeneity of the produced ingot. More particularly, the control of pressure and/or the composition of the gas over a melt makes it possible to deoxidize the melt with carbon or hydrogen, which in turn produce gaseous deoxidation products, which, if removed, can reduce the formation of solid non-metallic inclusions in the produced ingot.

The design and application of VAR have evolved to appreciable levels, as described in U.S. Pat. No. 4,450,570 to Weingartner et al., and patents referenced therein. Nevertheless, the lack of a thorough understanding of the metal vapor arc and its relationship with the metallurgy of the VAR process have hampered the production of ingots with rigorous quality standards. Few improvements have been made in the common VAR furnace to substantially increase its capacity to purify alloys through remelting. The apparatuses and methods of the present invention, through the application of heightened understanding of the conditions at the solidification interfaces, aid substantially in the production of higher quality ingots than those produced in furnaces common in the art.

SUMMARY OF THE INVENTION (DISCLOSURE OF THE INVENTION)

The invention involves an improvement in the art of VAR through the use of apparatuses and methods which result in enhanced purity of the produced ingot. Purification of the produced ingot is accomplished by accelerating the hydrogen reduction component of the chemistry of the metal vapor plasma, and by reducing the opportunity for evaporated contaminants to be reintroduced into the ingot during the course of a melt. The hydrogen reduction reaction is accelerated by introducing reactive gases in the excited state into the arc zone, and by condensing water vapor within the furnace chamber to reduce the vapor pressure of water over the melt. Additionally, by expanding the volume of the ingot mold during the course of a melt to account for the increasing volume of the ingot, the present invention maintains the arc zone near the top of the ingot mold, dramatically reducing the opportunity for condensed contaminants to recontaminate the ingot.

It is an object of the present invention to provide apparatuses and methods for improving the purity and homogeneity of ingots produced in consumable electrode furnaces.

It is another object of the present invention to provide apparatuses and methods of maintaining a relatively stationary arc zone in consumable electrode furnaces.

It is another object of the present invention to provide apparatuses and methods for removing evaporated contaminants from the chambers of consumable electrode furnaces.

It is another object of the present invention to provide apparatuses and methods for accelerating the purifying reduction reactions in VAR processes by introducing excited reactive gases into the arc zone.

It is another object of the present invention to provide apparatuses and methods for accelerating the purifying reduction reactions in VAR processes by reducing the partial pressure of water over the melt.

It is another object of the present invention to provide apparatuses and methods for minimizing the opportunity for condensed contaminate by-products of VAR processes to be reintroduced into produced ingots during the remelt.

It is another object of the present invention to provide apparatuses and methods to improve the purity and homogeneity of ingots produced in consumable electrode furnaces that are adaptable for use on existing common furnaces.

Other objects, advantages, and novel features, and further scope of the applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention will be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

Figure 1:
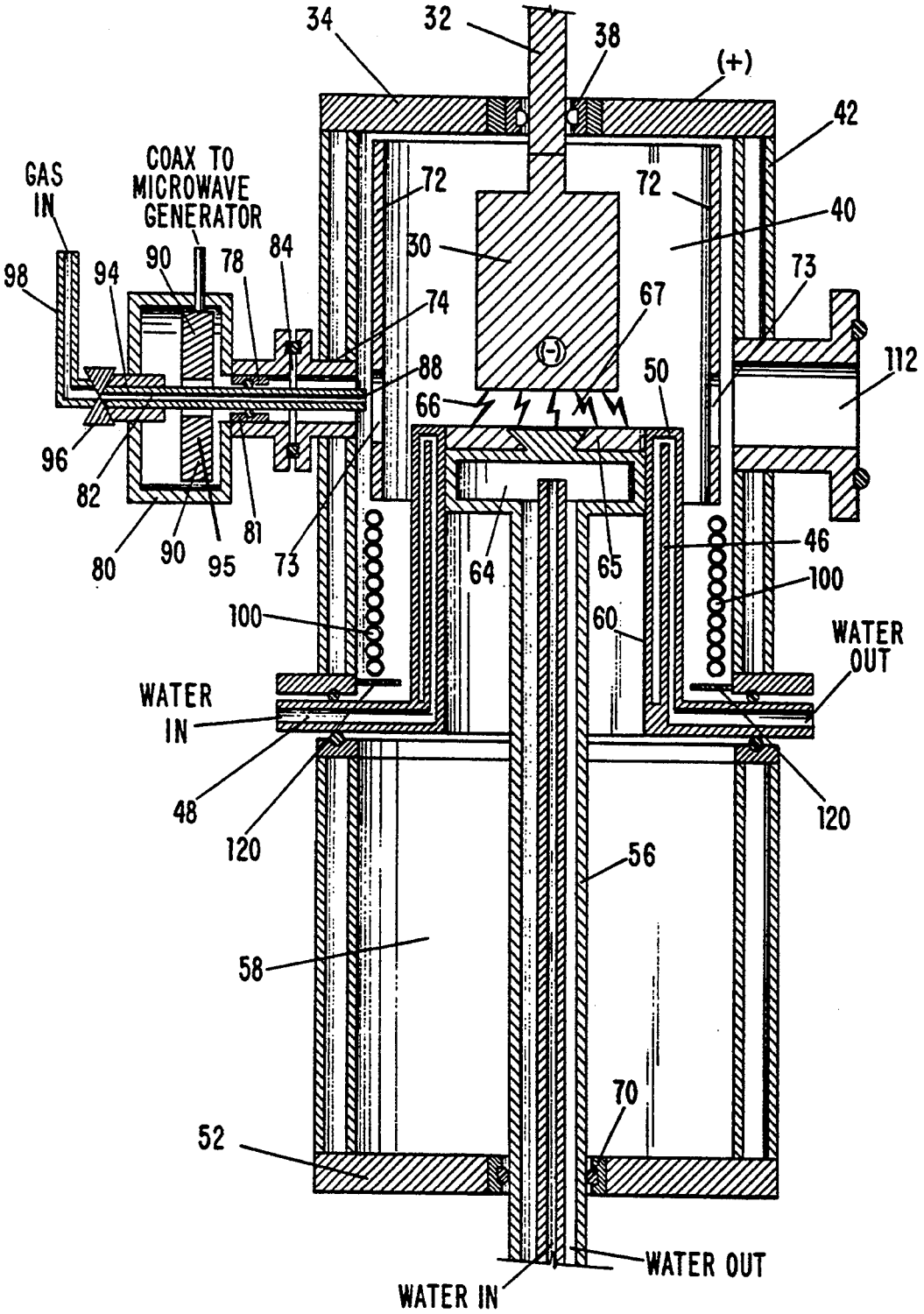
FIG. 1 is a section view of the preferred embodiment of the present invention before the melting process is commenced.

DESCRIPTION OF THE PREFERRED EMBODIMENT (BEST MODE FOR CARRYING OUT THE INVENTION)

The vacuum arc remelt process has tremendous potential for metal purification applications. Because melting occurs in a vacuum and in the presence of a hot metal vapor plasma, it is possible to reduce to an absolute minimum the opportunity for contaminants to enter the produced ingot during the melting and solidification processes. An object of the present invention is to employ the VAR process to produce ingots meeting elevated standards of purity and homogeneity by improving the design of the furnace in the arc region and by adding to the metal vapor plasma certain reactive gases in the excited (and unexcited) states. While the apparatuses and methods of the present invention have preferred and ready application in VAR consumable electrode furnaces, one skilled in the art will also appreciate that many of the advantages of the invention can, with adaptation, find application in plasma furnace technologies, and it is the intention of this disclosure to include such applications.

The typical prior art furnace is capable of producing 32-inch diameter round ingots, although ingot size is variable. This standard consumable-electrode furnace consists of two main sections: an above-ground chamber that encloses an electrode, and a water-cooled copper mold or crucible below ground level in which melting and solidification of the ingot occurs. Direct current is used for inducing an electric arc between the electrode and the mold. Normally, the electrode is connected to the negative terminal of the direct current source and the mold is connected to the positive; e.g., electrode serves as a cathode and the mold acts as an anode.

A combination of vacuum pumps, typically mechanical rotary and roots blower vacuum pump, then evacuates the furnace chamber to very low pressure. The electrical power is turned on, striking an arc between the lower end of electrode and a starting block placed in the mold before the process begins. Energy from the arc progressively melts the lower end of the electrode, which results in the formation of hot metal vapor plasma in the arc and between the electrode and the mold. Melted metal is transferred across the arc and deposited in the mold, first upon the bottom of the mold, then into a shallow pool of molten metal on the top surface of the ingot being built up in the mold. Solidification of the molten metal occurs mainly through radial heat extraction from the molten pool atop the ingot.

As the lower end of the electrode is consumed or melted away, the vertical position of the electrode is automatically adjusted at a controlled rate necessary to maintain the proper distance between the end of the electrode and the top surface of the ingot. This adjustment results from vertical movement of an electrode holder during the course of a melt which takes into account the shrinking length of the electrode as well as the rising level of the top surface of the growing ingot. This continual vertical adjustment of the electrode holder is controlled using various electromechanical methods known in the art. It thus is noted that at the beginning of a melt, the bottom of the electrode is very near the bottom of the mold; as the melt progresses, the electrode and the electrode holder are gradually lifted upward within the mold as the top of the ingot moves upward as a result of material deposition from the electrode to the ingot.

As shall be further explained hereinafter, the present state of vacuum art remelting art is limited in its ability to produce highly purified ingots. In the common consumable electrode furnace, opportunity abounds for contaminants ejected from the arc to be reintroduced into the forming ingot. This disadvantage is attributable primarily to the fact that the melting occurs within the mold or crucible, where evaporated contaminants are not removed from the vicinity of the ingot, instead condensing within the mold itself.

The present invention permits the user to improve the purity and homogeneity of produced ingots by improving the thermodynamics of the reduction reaction occurring in the arc zone by exploiting basic principles of chemical equilibrium theory. The hydrogen reduction reaction ($H_2+MO=H_2O+M$) is dictated by the stability of the metal oxide (MO) to be reduced, and the partial pressure of water (which acts as a brake on the reaction). As disclosed in more detail hereinafter, the fact that water is a major constituent in the furnace atmosphere has been demonstrated through testing. As with most chemical reactions, increased temperatures also increase the probability that the reduction reaction will occur.

The present invention accelerates the hydrogen reduction reaction in two ways and this improves ingot purity. First, microwave energy and/or radio frequency electromagnetic energy is employed to excite the hydrogen molecules injected into the arc zone, enhancing the probability that the hydrogen will bond with the oxygen molecules to be disassociated from the metal oxides found in the electrode and in the molten pool atop the ingot. Additionally, the invention prevents the build-up of water in the atmosphere of the furnace chamber by selectively pumping water vapor from that atmosphere by use of a cold surface placed near the melt in the furnace vacuum chamber. Basic principles of thermodynamics and chemical equilibrium dictate that by exciting the hydrogen reactant of the redox equation ($H_2+MO=H_2O+M$) and by removing $H_2O$ from the products (by lowering the partial pressure of water in the system), the entire equation is driven to the products side and increased purities of metal (M) produced. The present invention beneficially applies these principles.

Figure 2:
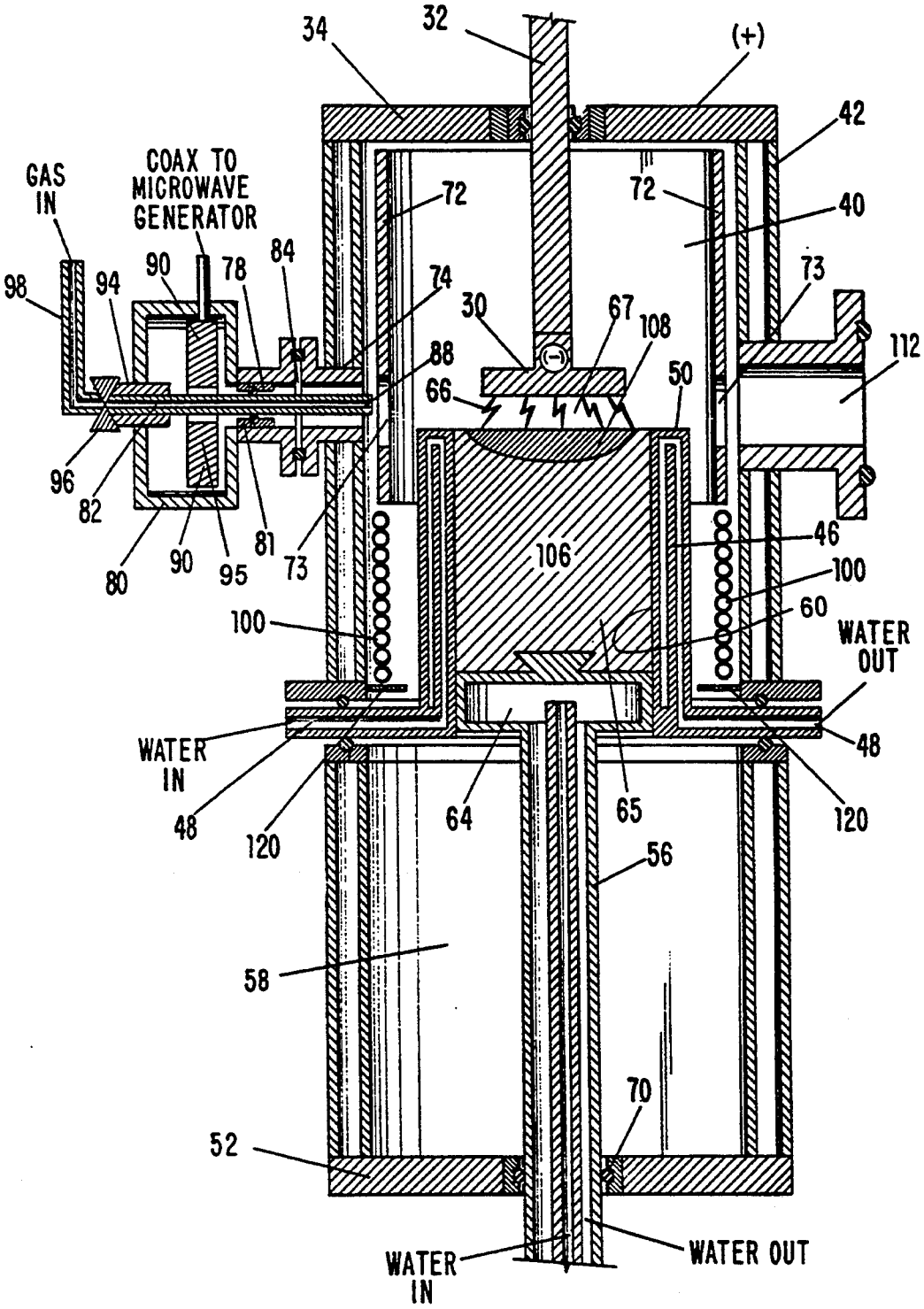
FIG. 2 is a section view of the embodiment of FIG. 1 after the melting process is substantially complete.

Reference is now made to FIG. 2, illustrating the apparatus of the invention prepared to begin a remelt. An electrode 30, composed of the material to be remelted is attached to an upper ram 32, using attachment methods known in the art. Upper ram 32 extends through the furnace top 34 and into furnace chamber 40. Upper ram 32 is connected to a mechanical or hydraulic mechanism (not shown), known in the art, permitting the controlled vertical movement of upper ram 32 into and out of furnace chamber 40. Sliding seals 38 common to the art provide for an airtight seal between furnace top 34 and upper ram 32. Upper ram 32 is composed of electrically conductive material, preferably copper. Because upper ram 32 is subjected to elevated temperatures during the course of a melt, it preferably is water-cooled. Upper ram 32 is electrically connected to the negative terminal of a high-amperage direct current power supply (not shown).

Furnace walls 42 enclose furnace chamber 40, and are water-cooled by means common in the art. Furnace walls 42 typically are circular, such that the entire furnace has the general configuration of a hollow cylinder. Furnace chamber 40 is evacuated using vacuum pumping systems (not shown) known in the art. In the preferred embodiment of the present invention, furnace chamber 40 is evacuated to between 0.002 and 0.1 torr.

Located within furnace chamber 40, at its horizontal center, is a crucible 46. Crucible 46 is made of electrically conductive metal, preferably copper, and preferably is cylindrical in shape to form a cylindrical mold. Crucible 46 has lip 50 about the circumference of its top. Crucible 46 is water-cooled by means of water guides 48. During a remelt, crucible 46 is electrically polarized positive.

Extending upward through the center of furnace bottom 52 and into withdrawal chamber 58 is lower ram 56. Lower ram 56 preferably is cylindrical and polarized to same polarity as crucible. (It is noted that lower ram 56, crucible 46, upper ram 32, electrode 30 and furnace walls 42 preferably are coaxial cylinders, sharing a common vertical axis through the center of the entire furnace.) Lower ram 56 is connected to a withdrawal mechanism (not shown) permitting the controlled vertical movement of lower ram 56 up and down within withdrawal chamber 58. Lower ram 56 is of sufficient length such that, when fully extended, it extends through withdrawal chamber 58 and into crucible 46. Withdrawal chamber 58, like furnace chamber 40, is evacuated during remelting using vacuum pumps known in the art. Bottom sliding seals 70 are used to seal lower ram 56 and withdrawal chamber 58.

Fixed to the top of lower ram 56 is water-cooled crucible base plate and dovetail 64. Crucible base plate 64, made of steel or any material capable of withstanding high temperatures without appreciable deformation, is shaped as a flat cylinder or disk. Crucible base plate 64 has a diameter less than the inside diameter of crucible 46, such that the outside circumference of crucible base plate 64 slides on the inner wall 60 of crucible 46 when lower ram 56 is extended into crucible 46. It is observed, therefore, that crucible base plate 64 serves as a bottom to crucible 46. By moving lower ram 56 up and down while crucible base plate 64 is inserted within crucible 46, the contained volume of crucible 46 may be varied. As illustrated in FIG. 1, when lower ram 56 is fully extended, the volume of crucible 46 approaches zero as crucible base plate 64 approaches lip 50 of crucible 46.

Attached electrically to the center of the top of crucible base plate and dovetail 64 is starting block 65, composed of the same material as the electrode. Starting block 65 facilitates the start-up of a melt by fostering the induction of an arc 66 between electrode 30 and crucible base plate 64, and provides a loose attachment to the water-cooled base plate and a dovetail on base plate 64 so that the ingot can be withdrawn. Metal vapor arc 66 provides energy to melt the lower tip of electrode 30.

Removable condensate collectors 72 are placed within furnace chamber 40, attached near the inside of furnace walls 42. Condensate collectors 72 preferably are thin, curved sheets composed of any durable, high-temperature material, such as stainless steel. Typically, condensate collectors 72 are sheets bent into curves conforming to the curvature of furnace walls 42, such that condensate collectors 72 can be mounted near and parallel to furnace wall 42 and concentrically therewith. Condensate collectors 72 preferably are mounted in the upper portions of furnace chamber 40, extending down the interior sides of furnace wall 42 only to a horizontal level somewhat below lip 50 of crucible 46. Condensate collectors 72 may contain holes 73 therethrough to permit use of viewing port 112 and injection orifice 88, as hereinafter described.

With continued reference to FIG. 1, it is seen that completely penetrating furnace wall 42 is injection port 74, a circular hole permitting the insertion of safety chamber coupling tube 78 into furnace wall 42. The outside diameter of safety chamber coupling tube 78 approximates the diameter of injection port 74, and a gasket seal (not shown) provides an airtight seal at the contact between safety chamber coupling tube 78 and furnace wall 42. Safety chamber coupling tube 78 is rigidly attached and sealed to, or preferably is an integral part of, safety chamber 80. Both safety chamber coupling tube 78 and safety chamber 80 are durable and unbreakable, and are preferably composed of stainless steel.

Safety chamber 80 is of no particular shape, but must be as nearly unbreakable in normal use as possible. As illustrated in FIG. 1, both safety chamber 80 and its accompanying coupling tube 78 are hollow with interconnected voids, so as to permit the disposition within them of injection tube 82. Injection tube 82 is mounted within the interior voids of both safety chamber 80 and safety chamber coupling tube 78, but preferably is electrically insulated from them by insulated mounts 84. Injection tube 82 must be composed of a material transparent to microwaves and radio frequency waves, and preferably is made of quartz. In the preferred embodiment, injection tube 82 has a horizontal disposition. The injection tube 82 is so mounted as to run the entire length of safety chamber coupling tube 78 (and thus through injection port 74), terminating with an injection orifice 88 slightly protruding into furnace chamber 40. Safety chamber 80 is sealed from the furnace chamber 40 by means of sliding chamber seal 81 around injection tube 82.

Disposed within the interior void of safety chamber 80 are one or more microwave cavities 90 and/or one or more water-cooled induction coils 95 to transmit radio frequency (50,000 to 800,000 cycles per second) electromagnetic energy into the injection tube 82. The microwave cavities 90 are hollow metal cylinders or other devices common to microwave technology used to directionally aim microwave energy. Within microwave cavities 90 are microwave emitters (not shown) connected to a microwave generator (such as that available from LECR Astrex, Model No. A-5000). Microwave cavities 90 are radially disposed around injection tube 82, such that a length of injection tube 82 passes near one, or between two or more, microwave cavities and thus may be subjected to directed microwave bombardment. The radio frequency induction coil will create an inductively coupled plasma with the injection tube. The radio frequency energy is provided by a radio frequency generator (not shown) that is electrically connected to the coil 95.

Injection tube 82 is externalized through a wall of safety chamber 80, the contact between injection tube 82 and the wall of safety chamber 80 being electrically insulated and airtight sealed by gaskets (not shown) located within the gas inlet 94 of safety chamber 80. Gas inlet 94 and injection tube 82 are coterminous at valve 96. Valve 96 connects injection tube 82 to gas supply line 98, which in turn is connected to a remote source of reactive gas (not shown), preferably hydrogen.

Removably mounted within furnace chamber 40, near the inner surface of furnace wall 42, is condensation surface 100. Condensation surface 100 is a hypercooled surface upon which water vapor may condense from within furnace chamber 40. Any cooled surface will advance the purposes of the invention, but condensation surface 100 preferably comprises metal tubes through which a refrigerant, preferably liquid nitrogen, is circulated. Alternatively, freon or suitable refrigerant gas may be circulated through the condensation surface. In the preferred embodiment, the metal tubes constituting condensation surface 100 are coiled, i.e. helically wound, about the interior of furnace chamber 40 near furnace wall 42, so as functionally to form a single cylindrical condensation surface 100 concentric with crucible 46. Condensation surface 100 preferably is located near the bottom of furnace chamber 40, so as not to interfere with the function of injection orifice 88 or condensate collectors 72.

FIG. 1 illustrates the initial operating principles of the invention. Lower ram 56 is extended into crucible 46 until starting block 65 is near the top of crucible 46 and starting block 65 is slightly lower than the lip 50. Electrode 30 is attached and electrically connected to upper ram 32. Upper ram 32 is lowered until the bottom of electrode 30 is a predetermined distance (determined by methods known in the art) from starting block 65. Furnace chamber 40 and withdrawal chamber 58 are evacuated. Electrical power to the system is activated (starting block 65 and crucible 46 charged positive, electrode 30 charged negative) inducing arc 66 between electrode 30 and starting block 65. The energy of arc 66 begins melting electrode 30, which begins to melt onto starting block 65 within crucible 46.

To increase the probability of the desirable redox reaction occurring, upon the striking of arc 66 and throughout the course of the melt, reactive gas(es) is introduced into the arc zone 67 via injection tube 82 and through injection orifice 88. The preferred reactive gas is hydrogen (preferably mixed with argon), but it is possible to excite other species of gas with the apparatus of the present invention, and tailor the excited species to other reaction products. Alternative reactive gases include, but are not limited to, gaseous nitrogen compounds such as ammonia and hydrocarbons such as methane. An object of the present invention is to elevate the probability of completed redox reactions by raising the dynamics of the introduced gas through microwave excitation or radio frequency induction.

The microwave generator, and/or radio frequency induction means, is activated at the beginning of the melt, and is operated throughout the course of the melt. During the melt, reactive gas is drawn from a remote source through gas supply line 98 and through injection tube 82, where it is subjected to microwave radiation emitted from microwave cavities 90 and/or radio frequency induction coils 95. In the preferred embodiment, the microwave energy has a frequency of about 2.45 gigahertz at up to 5.0 kilowatts. Such microwave bombardment thermodynamically excites or ionizes the reactive gas while it passes through injection tube 82 in the preferred embodiment, if an induction coil is used to transmit radio frequency waves, in inductively coupled plasma containing excited species of the reactive gas is generated within the injection tube 82. In the preferred embodiment, molecular hydrogen ($H_2$) is heated to elevated temperature, ionized, and also excited to a plasma state. The excited gas continues on through injection tube 82 and out injection orifice 88 near arc zone 67, where its excited state accelerates the redox reactions occurring in arc 66. It is noted that in the present invention arc zone 67 remains in the same location throughout the melt (due to the movement of crucible base plate 64 and upper ram 32), and injection orifice 88 may thus also be stationary.

The stationary, above-crucible location of arc zone 67 also permits the progress of the melt and the status of the arc 66 to be monitored visually through viewing port 112. In conventional furnaces known in the art, direct visual monitoring of the arc 66 is difficult or impossible, as the arc zone 67 is continuously moving upward inside the confines of a solid metal mold buried below ground level.

Microwave cavities 90 and/or induction coils 95 are contained in safety chamber 80 for safety reasons, as the gas to be excited must be passed through an electrically insulated injection tube 82. If injection tube 82 is ruptured, safety chamber 80 may be immediately closed off from the atmosphere using valve 96, thus reducing the likelihood of an explosion or other adverse results.

FIG. 2 illustrates the relative positions of electrode 30, crucible base plate 64, ingot 106, molten pool 108, arc zone 67, crucible 46 and lip 50 when a melt has been nearly completed. Once the arc 66 is struck and consumption of electrode commences, and throughout the course of the melt, the length of the arc gap between electrode 30 and molten pool 108 must be carefully maintained using automatic monitoring and control devices known in the art.

As illustrated in FIG. 2, however, in the preferred embodiment of the invention, arc zone 67 is continually maintained near the lip 50 of crucible 46. This is accomplished by making constant vertical adjustments in the position of upper ram 32 concurrently with the controlled withdrawal of lower ram 56. As noted in FIG. 1, the melt begins with crucible base plate 64 near the lip 50 of crucible 46. But with combined reference to FIGS. 1 and 2, it is noted that as the volume of ingot 106 increases through the solidification of molten pool 108 atop ingot 106, lower ram 56 is gradually withdrawn, lowering crucible base plate 64 to increase the contained volume of crucible 46 in direct proportion with the increasing volume of ingot 106. By this means, molten pool 108 is maintained constantly at the top of crucible 46 at the level of lip 50, from the beginning of the melt to its conclusion. Adjustment of upper ram 32 simultaneously with the withdrawal of lower ram 56 maintains the proper gap distance between electrode 30 and molten pool 108. The controlled movement of both upper ram 32 and lower ram 56 to maintain arc gap length is accomplished with monitoring and control systems known to the art.

A distinct advantage of the present invention is thus apparent. It is seen that in the prior art, the arc is struck, and the melt initiated, at the bottom and between the walls of the mold. The proper arc gap distance is maintained by adjusting the vertical position of the electrode holder. Also, and importantly, the increasing height of the ingot is accommodated in the device exclusively by raising the electrode; the walls and bottom of the mold are fixed. The melting electrode within the confines of the mold, however, prevents the contaminants ejected from the arc from escaping to the above-ground chamber. Instead, evaporated contaminants condense upon the interior walls of the mold, where they may be reintroduced into the ingot as the melt progresses.

Renewed reference is made to FIG. 2. By maintaining arc zone 67 at a fixed vertical position, the apparatus of the present invention minimizes the opportunity for evaporated contaminants to be reintroduced into the forming ingot 106. Because the arc 66 is maintained above lip 50 of crucible 46 throughout the course of the melt, the inner wall 60 of crucible 46 is never directly exposed to evaporated contaminants; crucible base plate 64, or molten pool 108 and/or ingot 106 are between inner wall 60 and arc 66 at all times, shielding inner wall 60 from contaminant condensation. Evaporated contaminants condense instead upon condensation collectors 72, from which they are later removed and discarded. The ingot 106 therefore is not exposed to condensed contaminants, and remains pure.

As the melt progresses, ingot 106 is continuously retracted as melted metal drips from electrode 30 so that molten pool 108 is always located at top of crucible 46. This provides a large surface area of exposure of the molten metal to the injected reactive gas. In the presence of near-vacuum conditions, impure or contaminated macroparticles and evaporates that are ejected by arc 66 condense upon condensate collectors 72. Condensed contaminants typically are composed of a wide variety of elements and compounds, usually with high vapor pressures, such as sulfur, magnesium, carbon and the like as well as various oxides. After the melt has been completed, condensate collectors 72 are removed from furnace chamber 40 for cleaning or replacement.

During the course of a melt, water vapor inevitably accumulates within furnace chamber 40; as previously mentioned, the presence of water vapor acts as a brake upon the desired reduction reaction. Applicant has demonstrated that water vapor is a major constituent in the furnace atmosphere during VAR of a Ti—6Al—4V alloy as shown by the data of Table 1. The concentration of water vapor in the furnace chamber before the arc was initiated for the trials in Table 1 is denoted by the column $H_2O$ B.

TABLE 1

Hydrogen and Water Levels (STD cc/min) Present During VAR of a Ti-6-Al-4V Alloy

| Melt # | H | $H_2$ | $H_2O$ | $H_2O$ B |
|---|---|---|---|---|
| M176 | 66 | 622 | 320 | 0.50 |
| M179 | 232 | 336 | 358 | 0.72 |
| M180 | 451 | 516 | 1244 | 1.53 |

The above data were collected in a VAR furnace having a leak up rates of less than 0.010 torr per hour. Gases were monitored dynamically during melting through a gold-plated quartz tube with a 0.38 mm diameter hole drilled in one end. The tube was connected to a UTi 100C quadrapole residual gas analyzer and both volumes were differentially pumped with a turbomolecular pump to a dynamic pressure of less than $10^{-5}$ torr. Furnace pressures during melting at currents of 3 kA were less than 0.020 torr. The system was calibrated before each melt by passing both He and Ar through a calibrated leak at a back pressure of 50 psia. The leak was calibrated to a traceable NBS standard and was found to pass 29 sccm Ar into a chamber held at 0.010 tort with a back pressure of 50 psia on the other side of the leak. Each data point represents an average of about a 3 minute interval (at a sample rate of 10 Hz) just before the arc emerged from the hearth. The He calibration value was used in computing the H and He concentrations and Ar was used to compute the water concentrations.

Accordingly, the redox reaction is fostered through the reduction of the partial pressure of water in furnace chamber 40. During the course of the melt, water vapor within furnace chamber 40 condenses upon hyper-cooled condensation surfaces 100. Upon condensing upon condensation surface 100, water vapor freezes to ice, and thus remains upon condensation surface 100. In the preferred embodiment of the invention, baffles 120 are attached to the inner side of furnace wall 42 above and/or below condensation surface 100 to insulate condensation surface from the heat of surrounding elements and the heat of arc 66. Such baffles 120 may consist of annular rings of sheet metal or other material, attached to furnace wall 42 concentric with crucible 46. Upon completion of the melt, condensation surface 100 is thawed and dried, either in situ or after removal from furnace chamber 40.

After the melt has been completed, furnace chamber 40 is restored to atmospheric pressure and ingot 106 is allowed completely to cool. Ingot 106 is then removed from crucible 46 for further processing.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A vacuum arc remelting furnace apparatus, comprising:

a furnace chamber;

a consumable electrode means formed of a material to be remelted within said furnace chamber;

a crucible means for collecting the melt from said consumable electrode means, said crucible means being mounted in said furnace chamber lower than said electrode means; and a condensation surface spaced from and adjacent to said furnace chamber and spaced between at least one of said consumable electrode or said crucible means and said furnace chamber.

2. A vacuum arc remelting furnace apparatus in accordance with claim 1 wherein said condensation surface further comprises at least one hyper-cooled surface for circulating a refrigeration fluid.

3. An apparatus in accordance with claim 2 wherein said refrigeration fluid comprises a water mixture.

4. An apparatus in accordance with claim 2 wherein said refrigeration fluid comprises liquid nitrogen.

5. A vacuum arc remelting apparatus in accordance with claim 2 wherein said hyper-surface comprises metal tubing spirally wound substantially around said crucible means.

6. A vacuum arc remelting furnace apparatus, comprising:

a furnace chamber:

a consumable electrode means formed of a material to be remelted within said furnace chamber;

a crucible means comprising a top, a crucible base, and sides to define a volume within said furnace chamber for collecting the melt from said consumable electrode means; and arc zone means for maintaining a stationary arc zone extending between said consumable electrode means and said crucible means, said arc zone means maintaining said arc zone at a fixed position relative to said furnace changer for a duration of the melt.

7. A vacuum arc remelting furnace in accordance with claim 6 wherein said crucible means further comprises a cylinder fixed relative to said furnace chamber; and said crucible base extends vertically across said cylinder and moves inside said cylinder; and said means for maintaining a stationary arc zone further comprises a means for adjusting the vertical position of said crucible base to vary the volume of said crucible means.

8. A vacuum arc remelting furnace in accordance with claim 7 wherein said adjusting means comprises a retractable ram.

9. An apparatus in accordance with claim 6 wherein said maintaining means comprises adjustable electrode means.

10. A vacuum arc remelting furnace in accordance with claim 7 further comprising:

a means for accelerating hydrogen reduction reactions of a material to be vacuum arc remelted wherein said means for accelerating hydrogen reduction reactions further comprises a condensation surface spaced from and adjacent to said furnace chamber and spaced between at least one of said consumable electrode or said crucible means and said furnace chamber wherein said condensation surface comprises a upper and lower surface.

11. The vacuum arc remelting furnace of claim 10, wherein said means for accelerating hydrogen reduction reactions comprises means for injecting reactive gas between said consumable electrode means and said crucible means, and said condensation surface substantially surrounds said consumable electrode means and extends below the top of said crucible cylinder.

12. The vacuum arc remelting furnace of claim 10, wherein said means for accelerating reduction reactions comprises condensation means for reducing the partial pressure of water over the material being vacuum arc remelted.

13. A vacuum arc remelting furnace in accordance with claim 11 further comprising means for energizing said reactive gas.

14. A vacuum arc remelting apparatus in accordance with claim 10 wherein said condensation surface substantially surrounds said consumable electrode means, the lower surface of said condensation surface extending below the top of said crucible means.

15. A vacuum arc remelting furnace in accordance with claim 6 wherein said means for maintaining a stationary arc zone comprises a means for adjusting the vertical movement of said consumable electrode means.

16. A vacuum arc remelting furnace in accordance with claim 6 wherein said volume is variable in direct proportion to the melt being formed from said consumable electrode means.

17. A vacuum arc remelting furnace in accordance with claim 6 further comprising at least one condensate collector spaced from and adjacent to said furnace chamber and spaced between said consumable electrode means and said furnace chamber wherein said condensate collector collects contaminants ejected from said consumable electrode means.

18. A vacuum arc remelting furnace in accordance with claim 17 wherein said condensate collector comprises a viewing port to monitor the melt from said consumable electrode means.

* * * * *